US008896641B2

(12) United States Patent
Kim et al.

(10) Patent No.: US 8,896,641 B2
(45) Date of Patent: Nov. 25, 2014

(54) ORGANIC LIGHT EMITTING DIODE DISPLAY DEVICE AND METHOD OF DRIVING THE SAME

(75) Inventors: Hyungjung Kim, Seoul (KR); DongKyoung Oh, Gumi-si (KR); SangHo Yu, Paju-si (KR); HyunKi Lee, Paju-si (KR); MunJun Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 324 days.

(21) Appl. No.: 13/484,511

(22) Filed: May 31, 2012

(65) Prior Publication Data

US 2012/0306947 A1 Dec. 6, 2012

(30) Foreign Application Priority Data

Jun. 1, 2011 (KR) ..... 10-2011-0052965
Aug. 31, 2011 (KR) ..... 10-2011-0087785

(51) Int. Cl.
*G09G 5/10* (2006.01)
*G09G 5/02* (2006.01)
*G09G 3/32* (2006.01)

(52) U.S. Cl.
CPC ..... *G09G 3/3233* (2013.01); *G09G 2300/0842* (2013.01); *G09G 2320/0242* (2013.01); *G09G 2320/0666* (2013.01); *G09G 2320/0673* (2013.01); *G09G 2320/103* (2013.01); *G09G 2340/06* (2013.01); *G09G 2360/16* (2013.01)
USPC ..... 345/694; 345/690

(58) Field of Classification Search
USPC ..... 345/690–699
See application file for complete search history.

(56) References Cited

U.S. PATENT DOCUMENTS

| | | | | |
|---|---|---|---|---|
| 5,929,843 | A * | 7/1999 | Tanioka | 345/600 |
| 2006/0284805 | A1* | 12/2006 | Baek | 345/88 |
| 2009/0059078 | A1* | 3/2009 | Kim et al. | 348/645 |
| 2009/0278867 | A1* | 11/2009 | Brown Elliott et al. | 345/690 |
| 2010/0214497 | A1 | 8/2010 | Fujisaki et al. | |
| 2011/0149166 | A1* | 6/2011 | Botzas et al. | 348/649 |
| 2011/0254878 | A1* | 10/2011 | Mori et al. | 345/690 |

FOREIGN PATENT DOCUMENTS

| | | | |
|---|---|---|---|
| CN | 101378514 | A | 3/2009 |
| CN | 101387776 | A | 3/2009 |
| CN | 101813874 | A | 8/2010 |
| TW | 200701146 | A | 1/2007 |
| TW | I318759 | B | 12/2009 |

OTHER PUBLICATIONS

Office Action dated Mar. 26, 2014, issued by the State Intellectual Property of China in Chinese Patent Application No. 201210182704.6.

* cited by examiner

*Primary Examiner* — William Boddie
*Assistant Examiner* — Amy C Onyekaba
(74) *Attorney, Agent, or Firm* — Morgan, Lewis & Bockius LLP

(57) ABSTRACT

An organic light emitting display device includes: a display panel including red, green, blue, and white (RGBW) subpixels; a first data conversion unit configured to convert red, green, and blue (RGB) data signals into RGBW data signals; an average picture level calculation unit configured to calculate an average picture level (APL) for the RGB data signals; a peak luminance controller configured to control luminance of at least one frame by using the APL and a look-up table; and a data compensation unit configured to perform a compensation operation on at least one of the RGB data signals in response to color coordinates of white (W) data signals among the RGBW data signals output from the first data conversion unit being different from a target value.

20 Claims, 17 Drawing Sheets

ORGANIC LIGHT EMITTING DIODE DISPLAY DEVICE AND METHOD OF DRIVING THE SAME

CROSS-REFERENCE TO RELATED APPLICATION(S)

This application claims the benefit under 35 U.S.C. §119(a) of Korean Patent Applications No. 10-2011-0052965, filed on Jun. 1, 2011, and No. 10-2011-0087785, filed on Aug. 31, 2011, in the Korean Intellectual Property Office, the entire disclosure of each of which is incorporated by reference herein for all purposes.

BACKGROUND

1. Field of the Invention

The following description relates to an organic light emitting diode display device and method of driving the same.

2. Discussion of the Related Art

An organic electro-luminescence (EL) element, e.g., an organic light emitting diode (OLED), employed in an organic light emitting display device is a self-emissive element in which a light emitting layer is formed between two electrodes. Specifically, in the organic EL element, electrons and holes are injected into a light emitting layer from an electron injection electrode (or a cathode) and a hole injection electrode (or an anode), respectively, and excitons are formed when the injected electrons and holes are combined and emit light when the excitons transition from an excited state to a ground state.

In the organic light emitting display device, when scan signals, data signals, power, and the like, are supplied to subpixels disposed in a matrix form, selected subpixels emit light, thus displaying an image. Organic light emitting display devices can be classified into red/green/blue (RGB) organic light emitting display devices having red (R), green (G), and blue (B) sub-pixels and red/green/blue/white (RGBW) organic light emitting display devices having R, G, B, and white (W) sub-pixels.

An RGB organic light emitting display device uses a peak luminance control (PLC) method which is implemented by varying a gamma voltage according to an average picture level (APL) which is calculated based on a luminance component of RGB sub-pixels. The peak luminance control method has an advantage in adjusting a luminance according to display images.

Thus, the RGB organic light emitting display device may reduce power consumption and increase the display quality by using the peak luminance control method. On the other hand, an RGBW organic light emitting display device does not use a peak luminance control method. Thus, a power consumption of the related art RGBW organic light emitting display device is greater than the RGB organic light emitting display device. Accordingly, the RGBW organic light emitting display device is required to reduce the power consumption and to increase the display quality.

SUMMARY

Embodiments of the present invention relate to an organic light emitting diode display device and method of driving the same.

Advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose according to an aspect of the present invention, there is provided an organic light emitting display device, including: a display panel including red, green, blue, and white (RGBW) subpixels, a first data conversion unit configured to convert red, green, and blue (RGB) data signals into RGBW data signals, an average picture level calculation unit configured to calculate an average picture level (APL) for the RGB data signals, a peak luminance controller configured to control luminance of at least one frame by using the APL and a look-up table, and a data compensation unit configured to perform a compensation operation on at least one of the RGB data signals in response to color coordinates of white (W) data signals among the RGBW data signals output from the first data conversion unit being different from a target value.

According to another aspect of the present invention, there is provided a method of driving an organic light emitting display device, the method including: a data conversion operation of converting red, green, and blue (RGB) data signals into red, green, blue, and white (RGBW) data signals, an average picture level calculation operation of calculating an average picture level (APL) for the RGB data signals, a data generation operation of generating data signals, such that a data signal selected from among the RGB signals is supplied in a display panel in response to color coordinates of the white (W) data signal among the RGBW data signals being different from a target value, and a gain calculation operation of: multiplying an arithmetical value, obtained by performing an arithmetical operation on a current APL and a maximum APL, with a value corresponding to a difference between a gain of the RGB data signals corresponding to the maximum APL and a gain of the RGB signals corresponding to a target peak luminance APL, and adding the gain of the RGB data signals corresponding to the target peak luminance APL to the result value of the multiplication to calculate the correction gain value of the RGB data signals.

According to another aspect of the present invention, there is provided an organic light emitting display device, including: a display panel including red, green, blue, and white (RGBW) subpixels, a scan driver and a data driver configured to drive scan lines and data lines of the display panel, respectively, a timing controller configured to control the scan driver and the data driver, a data extraction unit configured to: determine a representative value of every pixel in one frame data supplied from the outside, and average the representative values over all of the pixels, an average picture level (APL) calculation unit configured to calculate an APL by performing an arithmetical operation on the averaged representative values extracted from the data extraction unit, and a peak luminance controller configured to control luminance of each of at least one frame by using the APL calculated by the APL calculation unit and a look-up table.

According to another aspect of the present invention, there is provided a method of driving an organic light emitting display device, the method including: determining a representative value for each respective pixel, such that a subpixel value including a greatest data value among red, green, and blue (RGB) subpixels in a single pixel is determined as a representative value for the single pixel, subsequently averaging the representative values over all of the pixels, calculating an average picture level (APL) by performing an arithmetical operation on the extracted averaged representative values, and controlling the luminance of each of at least one frame by using the calculated APL and a look-up table.

It is to be understood that both the foregoing general description and the following detailed description are examples and explanatory and are intended to provide further explanation of embodiments of the invention as claimed.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

Figure 1:
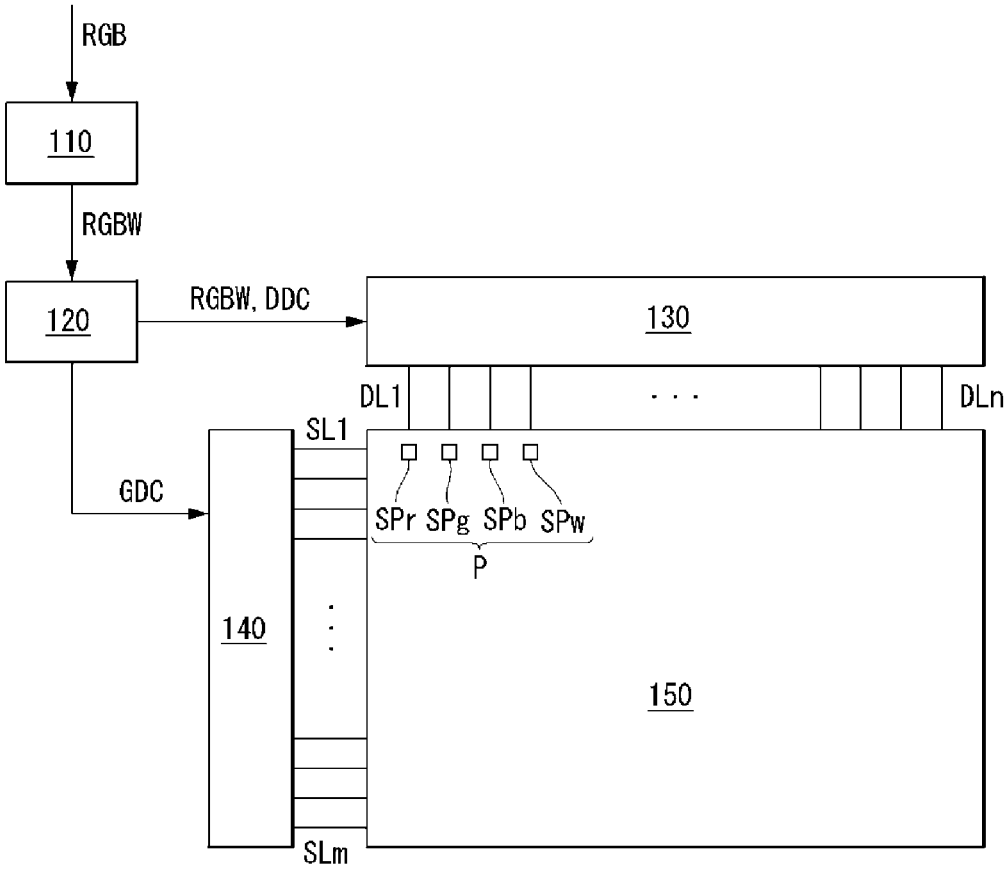
FIG. 1 is a schematic block diagram of an organic light emitting display device according to a first example embodiment.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to the preferred embodiments of the present invention, examples of which are illustrated in the accompanying drawings. Like reference numerals designate like elements throughout the specification. In the following description, when a detailed description of well-known functions or configurations related to this document is determined to unnecessarily cloud a gist of the invention, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a certain order. Names of the respective elements used in the following explanations are selected only for convenience of writing the specification and may be thus different from those in actual products

First Example Embodiment

Figure 2:
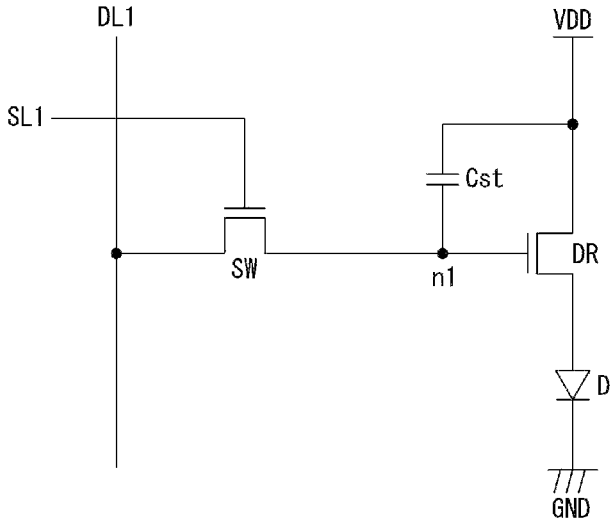
FIG. 2 is an example of a circuit diagram of a subpixel.
Figure 3:
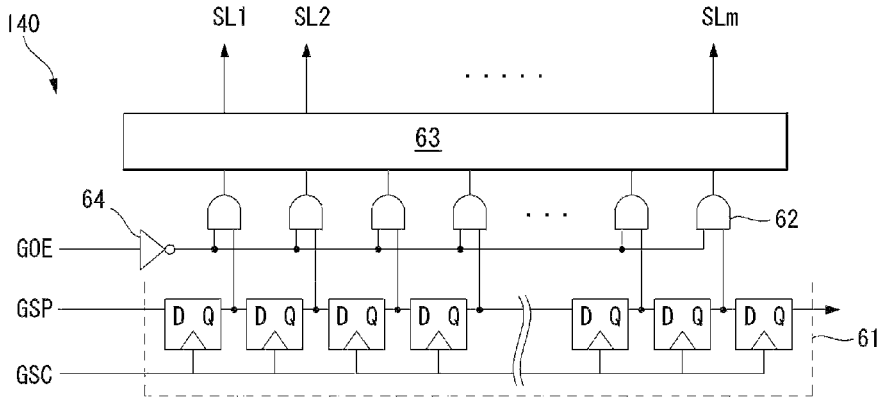
FIG. 3 is an example of a block diagram of a scan driver.
Figure 4:
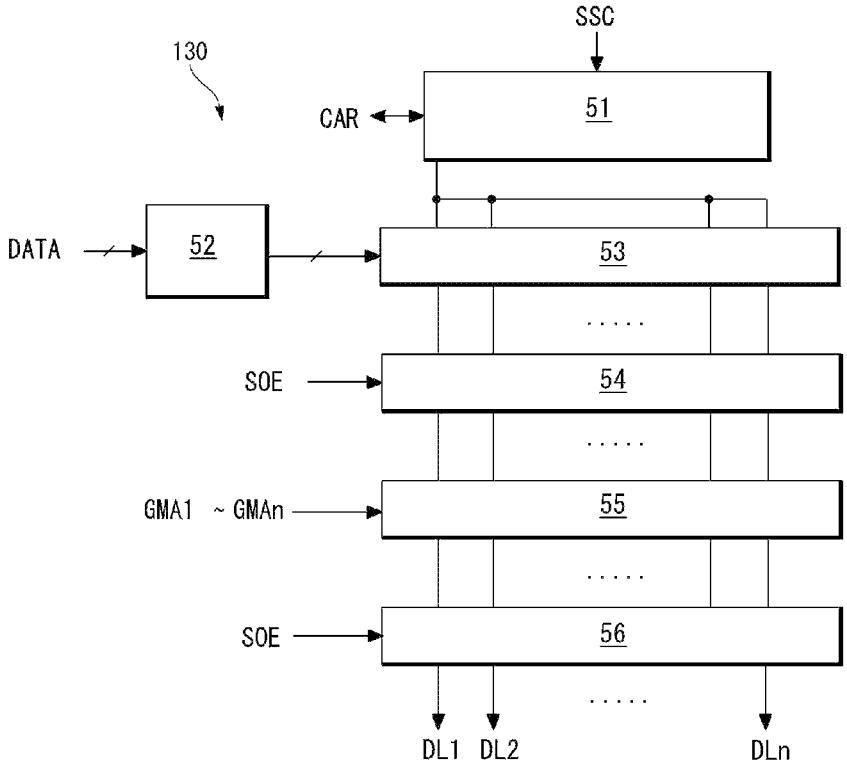
FIG. 4 is an example of a block diagram of a data driver.

FIG. 1 is a schematic block diagram of an organic light emitting display device according to a first example embodiment. FIG. 2 is a view showing an example of a circuit configuration of a subpixel. FIG. 3 is a block diagram showing an example of a scan driver. FIG. 4 is a block diagram showing an example of a data driver.

As shown in FIG. 1, an organic light emitting display device according to the first example embodiment may include an image processing unit 110, a timing controller 120, a data driver 130, a scan driver 140, and a display panel 150.

The display panel 150 may be formed as an organic light emitting display panel including subpixels SPr, SPg, SPb, and SPw disposed in a matrix form. The subpixels SPr, SPg, SPb, and SPw represent a red subpixel, a green subpixel, a blue subpixel, and a white subpixel respectively, and these subpixels may form a single pixel P.

As shown in FIG. 2, each of the subpixels may include a switching transistor SW, a driving transistor DR, a capacitor Cst, and an organic light emitting diode (OLED) D. In response to a scan signal supplied through a first scan line SL1, the switching transistor SW may be turned on or turned off to perform a switching operation to allow a data signal supplied through a first data line DL1 to be supplied to a first node n1. The data signal may be stored as a data voltage in the capacitor Cst. The driving transistor DR may operate to allow a driving current to flow between a first power source terminal VDD and a second power source terminal GND according to the data voltage stored in the capacitor Cst. The OLED D may operate to emit light according to the driving current flowing through the driving transistor DR.

As mentioned above, the subpixels SPr, SPg, SPb, and SPw may be configured to have a structure including the switching transistor SW, the driving transistor DR, the capacitor Cst, and the OLED D. This structure may be referred to as a "2T1C" for short, where "T" stands for transistor and "C" stands for capacitor, i.e., two transistors and one capacitor. The subpixels SPr, SPg, SPb, and SPw may also be configured to have a structure including additional transistors and capacitors, such as 3T1C (three transistors, one capacitor), 4T2C (four transistors, two capacitors), 5T2C (five transistors, two capacitors), or the like.

The subpixels SPr, SPg, SPb, and SPw may be formed according to a top emission scheme, a bottom emission scheme, or a dual-emission scheme, depending on a desired structure. Meanwhile, the red subpixel SPr, the green subpixel SPg, and the blue subpixel SPb may be implemented according to a color filter usage scheme on the basis of the white subpixel SPw, or may be implemented according to a scheme in which an organic substance included in the OLED D of the subpixels is formed to have a corresponding color, or the like. Embodiments of the present invention are not limited to these examples.

The image processing unit 110 may receive a vertical synchronization signal, a horizontal synchronization signal, a data enable signal, a clock signal, and RGB data signals RGB. The image processing unit 110 may convert the RGB data signals RGB into RGBW data signals RGBW and may supply the converted RGBW data signals to the timing controller 120. The image processing unit 110 may determine the gamma voltages for implementing peak luminance control according to an average picture level (APL) for the RGB data signals RGB. The image processing unit 110 may perform various types of image processing, details of which will be described later.

The timing controller 120 may receive the vertical synchronization signal, the horizontal synchronization signal, the data enable signal, the clock signal, and the RGBW data signals RGBW from the image processing unit 110. The timing controller 120 may control an operation timing of the data driver 130 and the scan driver 140 using the timing signals, such as the vertical synchronization signal, the horizontal synchronization signal, the data enable signal, the clock signal, and the like. The timing controller 120 may determine a frame period by counting the data enable signal of one horizontal period so that the vertical synchronization signal and the horizontal synchronization signal supplied from the outside may be omitted. Control signals generated by the timing controller may include a gate timing control signal GDC for controlling an operation timing of the scan driver 140 and a data timing control signal DDC for controlling an operation timing of the data driver 130. The gate timing control signal GDC may include a gate start pulse, a gate shift clock, a gate output enable signal, and the like. The data timing control signal DDC may include a source start pulse, a source sampling clock, a source output enable signal, and the like.

In response to the gate timing control signal GDC supplied from the timing controller 120, the scan driver 140 may sequentially generate scan signals to drive the transistors in the subpixels SPr, SPg, SPb, and SPw included in the display panel 150. The scan driver 140 may supply the generated scan signals to the subpixels SPr, SPg, SPb, and SPw included in the display panel 150 through scan lines SL1-SLm.

As shown in FIG. 3, the scan driver 140 may include a shift register 61, a level shifter 63, a plurality of AND gates 62 connected between the shift register 61 and the level shifter 63, an inverter 64 for inverting a gate output enable signal GOE, and the like. The shift register 61 may sequentially shift a gate start pulse GSP using a plurality of dependently connected D flip-flops according to a gate shift clock GSC. Each of the AND gates 62 may "AND" (logical product) an output signal from the shift register 61 and an inverted signal of the gate output enable signal GOE to generate an output, e.g., the output of each AND gate is logical high only when both of its inputs are logical high. The inverter 64 may invert the gate output enable signal GOE and may supply the same to the AND gates 62. The level shifter 63 may shift an output voltage swing width of the AND gates 62 into a swing width of a scan voltage. Scan signals output from the level shifter 63 may be sequentially supplied to the gate lines SL1-SLm. In FIG. 3, the scan driver 140 is illustrated in the form of an integrated circuit (IC). However, embodiments of the present invention are not limited thereto, and the scan driver 140 may be provided in the form of a gate-in panel on the display panel 150 through a thin film transistor (TFT) process.

In response to the data timing control signal DDC supplied from the timing controller 120, the data driver 130 may sample the RGBW data signals RGBW supplied from the timing controller 120 and may latch the sampled signals to convert them into parallel data signals. For example, in response to the data driver 130 converting the sampled signals into the data signals having the parallel data signals, the data driver 130 may convert the RGBW data signals RGBW from digital data signals into analog data signals according to a gamma voltage. For example, the digital data signals may be converted into the analog data signals by a digital-to-analog converter (DAC) included in the data driver 130. The data driver 130 may supply the converted RGBW data signals RGBW to the subpixels SPr, SPg, SPb, and SPw included in the display panel 150 through the data lines DL1-DLn.

As shown in FIG. 4, the data driver 130 may include a shift register 51, a data register 52, a first latch 53, a second latch 54, a conversion unit 55, an output circuit 56, and the like. The shift register 51 may shift a source sampling clock SSC supplied from the timing controller 120. The shift register 51 may deliver a carrier signal CAR to a next shift register. The data register 52 may temporarily store the data signals RGBW supplied from the timing controller 120 and may supply them to the first latch 53. The first latch 53 may sample data signals RGBW input in series according to a clock sequentially supplied from the shift register 51, latch them, and then, simultaneously output the latched signals. The second latch 54 may latch the data signals RGBW supplied from the first latch 53, and then, may simultaneously output the latched signals in synchronization with the second latch 54 of different source drive ICs in response to a source output enable signal SOE. The conversion unit 55 may convert the data signals RGBW input from the second latch 54 into gamma voltages GMA1-GMAn. The data signals RGBW output from the output circuit 56 may be supplied to the data lines DL1-DLn in response to the source output enable signal SOE. The data driver 130 illustrated in FIG. 4 is merely illustrative and embodiments of the present invention are not limited thereto. For example, the data driver 130 may be provided in various forms.

The organic light emitting display device according to the first example embodiment will be described in more detail as follows.

Figure 5:
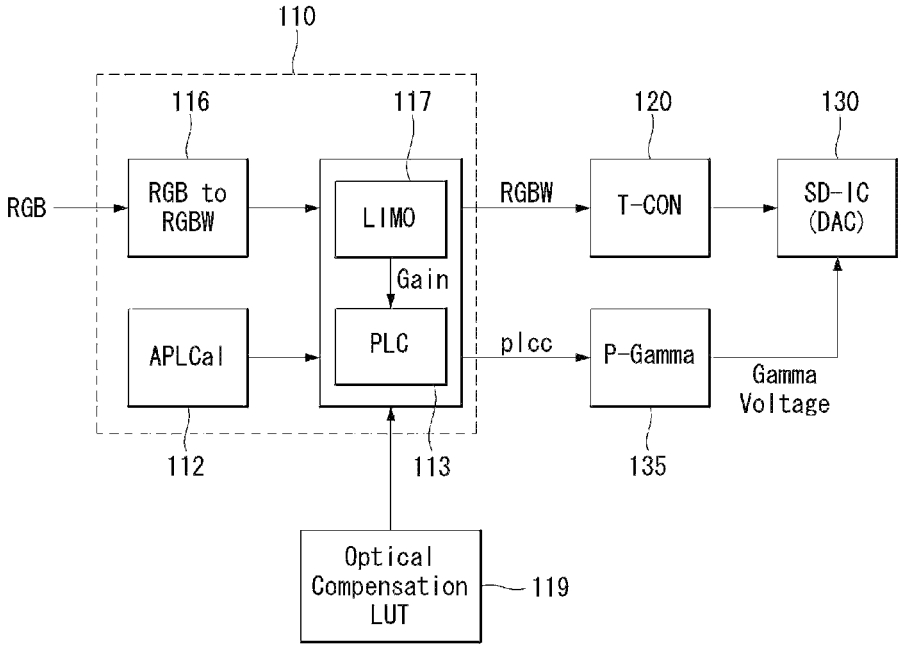
FIG. 5 is a block diagram showing a portion of an organic light emitting display device according to the first example embodiment.
Figure 6:
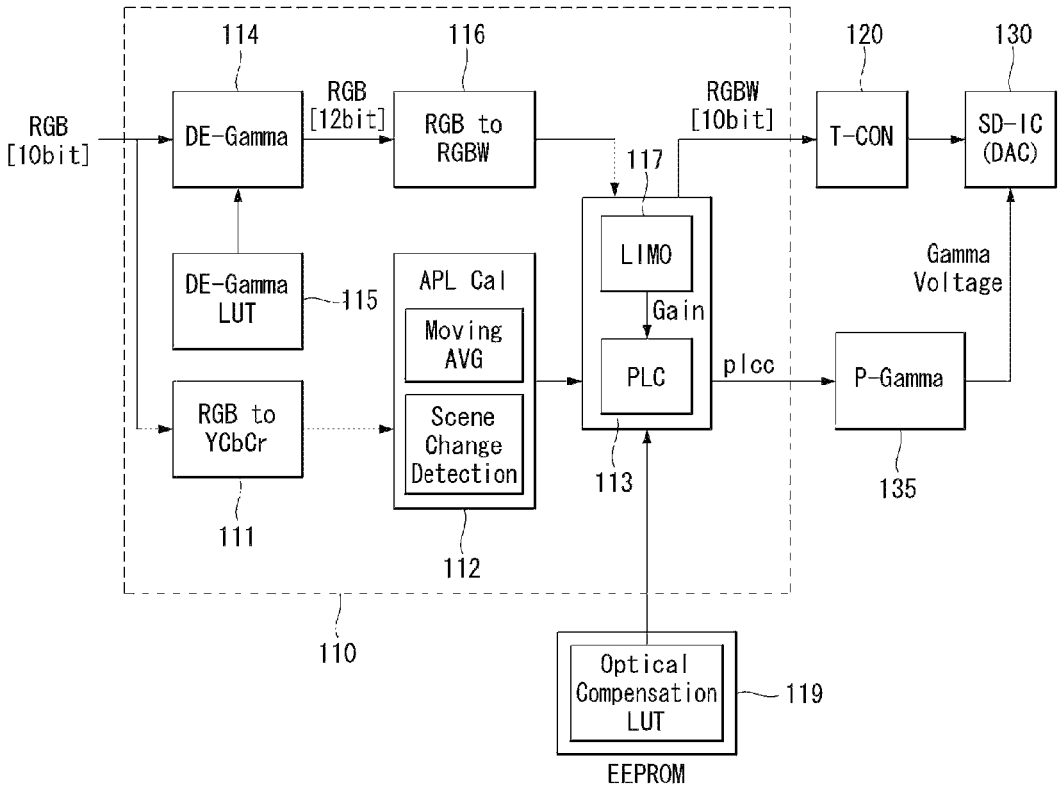
FIG. 6 is a more detailed block diagram showing a portion of an organic light emitting display device according to the first example embodiment.
Figure 7:
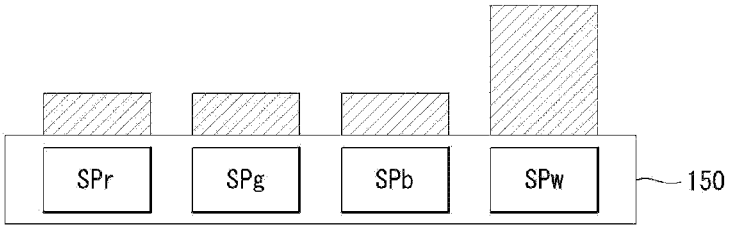
FIG. 7 is a chart explaining an example of a color coordinate compensation scheme of a data compensation unit.
Figure 8:
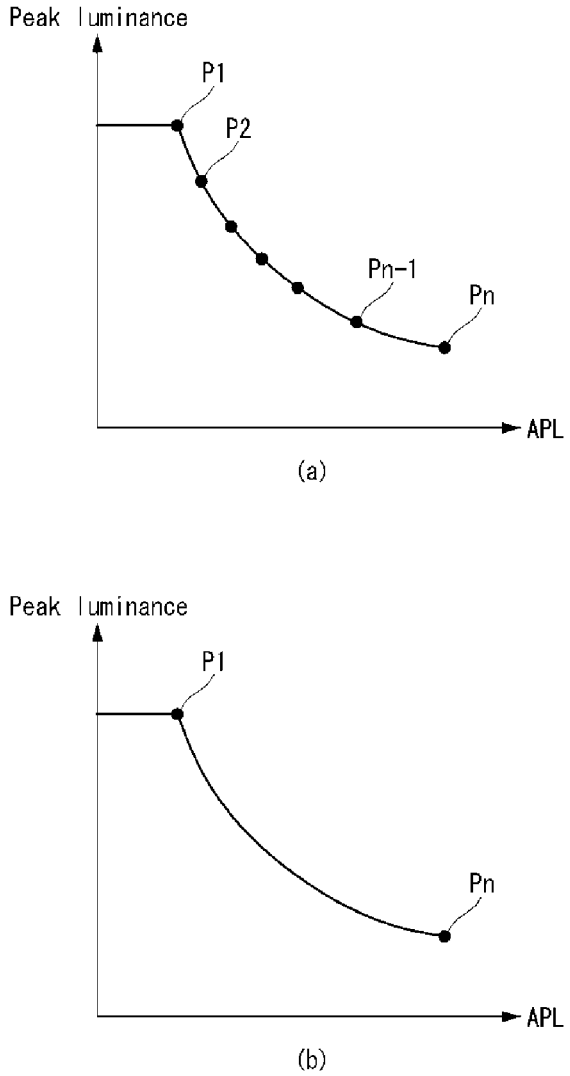
FIG. 8 is two graphs illustrating an example of a peak luminance control scheme according to a related art scheme of a comparative example in comparison to a scheme of the first example embodiment.
Figure 9:
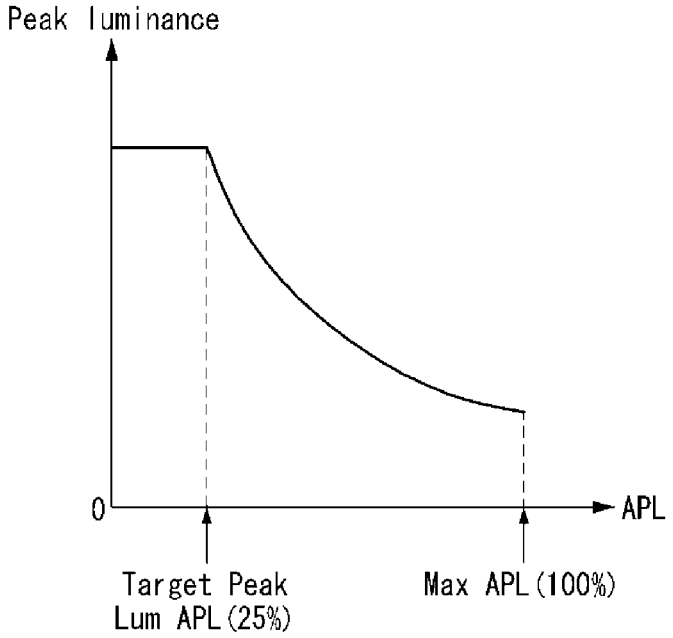
FIG. 9 is a graph explaining, in more detail, the peak luminance control scheme according to the first example embodiment.

FIG. 5 is a block diagram showing a portion of the organic light emitting display device according to the first example embodiment. FIG. 6 is a more detailed block diagram showing a portion of an organic light emitting display device according to the first example embodiment. FIG. 7 is a view explaining an example of a color coordinate compensation scheme of a data compensation unit. FIG. 8 is a graph explaining an example of a peak luminance control scheme according to a scheme of the first example embodiment in comparison to a comparative example scheme. FIG. 9 is a graph explaining, in more detail, the peak luminance control scheme according to the first example embodiment.

As shown in FIGS. 5 and 6, the organic light emitting display device according to the first example embodiment may include the image processing unit 110, the timing controller 120, the data driver 130, and a gamma unit (P-Gamma) 135. The organic light emitting display device further includes an optical compensation look-up table (LUT) 119.

As shown in FIG. 5, the image processing unit 110 may include a first data conversion unit (RGB to RGBW) 116, a data compensation unit (LIMO) 117, an average picture level (APL) calculation unit 112, and a peak luminance controller (PLC) 113. As shown in FIG. 6 in more detail, the image processing unit 110 may further include a DE-gamma unit 114, a DE-gamma look-up table (LUT) 115, and a second data conversion unit (RGB to YCbCr) 111.

The DE-gamma unit 114 may serve to de-gamma process the RGB data signals included in a single frame. For example, to prevent a bit overflow, or the like, that may occur during an arithmetic operation of converting the RGB data signals input from the outside into the RGBW data signals, the DE-gamma unit 114 may de-gamma process a received inverse gamma to change it into a linear form, and then may perform bit stretching thereon. In one example, through the bit stretching performed by the DE-gamma unit 114, the RGB data signals may be changed from 10 bits to 12 bits and then output. The DE-gamma unit 114 may perform bit stretching by using the DE-gamma look-up table (LUT) 115.

The first data conversion unit (RGB to RGBW) 116 may convert the RGB data signals output from the DE-gamma unit 114 into RGBW data signals. One reason for converting the RGB data signals into the RGBW data signals by using the first data conversion unit (RGB to RGBW) 116 is to drive the display panel including the RGBW subpixels.

The second data conversion unit (RGB to YCbCr) 111 may convert the RGB data signals supplied from the outside into YCbCr data signals. In one example, the second data conversion unit (RGB to YCbCr) 111 may convert the RGB data signals into the YCbCr data signals by using a transformation formula, such as Equation 1 shown below.

$$\begin{bmatrix} Y \\ Cb \\ Cr \end{bmatrix} = \begin{bmatrix} 0.299000 & 0.587000 & 0.114000 \\ -0.168736 & -0.331264 & 0.500000 \\ 0.500000 & -0.418688 & -0.081312 \end{bmatrix} \begin{bmatrix} R \\ G \\ B \end{bmatrix} \quad \text{[Equation 1]}$$

When the RGB data signals are converted into the YCbCr data signals, the APL calculation unit 112 may calculate an APL on the basis of the converted YCbCr data signals.

The APL calculation unit 112 may calculate an APL for the YCbCr data signals supplied from the second data conversion unit 111. In one example, the APL calculation unit 112 can also calculate an APL for other types of data signals than the YCbCr data signals. For example, rather than converting the RGB data signals into the YCbCr data signals, the second data conversion unit 111 may perform a different operation, e.g., an operation of extracting only a maximum value of the RGB data signals, or the like, or may delete it. The APL calculation unit 112 may re-calculate the averaged representative values, i.e., may average again the averaged representative value in units of Nth frames (e.g., 5 frames, 30 frames, or the like) so that the identical APL can be applicable to a plurality of frames (certain amount of frames). Problems, such as flickering, or the like, that may arise when calculation is performed for every frame can be prevented. The APL calculation unit 112 may calculate the APL on the basis of a moving AVG of an image or on the basis of scene change detection.

When color coordinates of the W data signal among the RGBW data signals output from the first data conversion unit 116 are different from a target value, the data compensation unit (LIMO) 117 may output compensated RGBW data signals for displaying desired color coordinates. In an example using a display panel including RGBW subpixels, in response to a W image being displayed, only the W subpixel may be used. In one example, the color coordinates of the W subpixel may be different from a target value. Therefore, the data compensation unit 117 may generate the compensated RGBW data signals by adding at least one of the R, G, and B signals to W signal, as shown in FIG. 7. For example, the RGBW data signals RGBW may be changed from 12 bits to 10 bits by the data compensation unit 117 and then output from the data compensation unit 117. The data compensation unit 117 may multiply a value, obtained by performing an arithmetic operation on a current APL and a maximum APL, to a value of the difference between a gain of the RGB data signals corresponding to the maximum APL and a gain of the RGB data signals corresponding to a target peak luminance PL to obtain a result value. In addition, the data compensation unit 117 may add the gain of the RGB data signals corresponding to the target peak luminance APL to the result value to calculate (or obtain) correction gain values Gain of the RGB data signals.

The peak luminance controller (PLC) 113 may control peak luminance of at least one frame by using the APL calculated by the APL calculation unit 112, the correction gain values Gain of the RGB data signals supplied from the data compensation unit (LIMO) 117, and an optical compensation data signal from an optical compensation LUT 119. As such, the PLC 113 may generate a luminance control value plcc for controlling luminance of the frame on the basis of the correction gain values supplied from the data compensation unit 117. The PLC 113 may perform peak luminance control by supplying the luminance control value plcc to the gamma unit (P-Gamma) 135 which in turn may provide a gamma voltage to the data driver (SD-IC) 130. For example, for the LUT 119, an internal or an external memory, such as an electrically erasable programmable read-only memory (EEPROM), storing the optical compensation data signal may be used. The gamma unit 135 may use a programmable gamma voltage (or gamma curve) which can be changed in response to the luminance control value plcc supplied from the PLC 113.

The data compensation unit 117 may calculate the correction gain values Gain of the RGB data signals through the following Equation 2, which expresses a current gain of a data signal selected among the RGB data signals. Thus, the data compensation unit 117 may calculate the correction gain values Gain of the RGB data signals based on the current gain of the data signal.

Current gain of data signal=(Max APL RGB gain−Target Peak Lum APL RGB gain)*{(Current APL−Target Peak Lum APL)/(Max APL−Target Peak Lum APL)}+Target Peak Lum APL RGB gain+RGB gain weight [Equation 2]

For example, "Max APL RGB gain" is an actual gain measurement value of the RGB data signals corresponding to the maximum APL, "Target Peak Lum APL RGB gain" is an actual gain measurement value of the RGB data signals corresponding to the target peak luminance APL, "Current APL" is a current APL, "Max APL" is a maximum APL, "Target Peak Lum APL" is a target peak luminance APL, and "RGB gain weight" is a gain weight of the RGB data signals.

The data compensation unit 117 may perform compensation for the green and blue (GB) data signals using the current gain calculated in accordance with Equation 2. In this example, for the R subpixel included in the display panel, it may have improved efficiency in comparison to the other GB subpixels. Thus, the current gain for the R data signal may not be calculated. Instead, in response to the current gain for the R data signal being required to be calculated, Equation 2 may be used. In comparison, because the B subpixel included in the display panel (in this example) may have less light emission efficiency than the R and G subpixels, increase and decrease widths of the compensation gain value in the B subpixel may nonlinearly increase as the B subpixel goes to low or high gray levels. Thus, for the B data signal, a gain weight of the B data signal may be additionally included in Equation 2, and the gain weight of the B data signal may be prepared on the basis of an actual measurement value obtained by measuring the characteristics of the B subpixel formed in the display panel. For example, the gain weight of the B data signal may vary according to device characteristics. Also, for the red and green (RG) data signals, a gain weight prepared on the basis of an actual measurement value obtained by measuring the characteristics of the red and green (RG) subpixels may be further added, and in such a case, the gain weight may be added generally as "0". One reason is because the light emitting efficiency of the RG subpixels may be higher than that the light emitting efficiency of the B subpixel. However, in response to the light emitting efficiency of the RG subpixels being different from this, a gain weight may be added for the RG subpixels.

Meanwhile, the calculation of the correction gain value Gain by the data compensation unit 117 will be further described with reference to a scheme (b) of the first example embodiment in comparison to a related art scheme (a) of the comparative example shown in FIG. 8.

First, in the related art scheme (a) of the comparative example, to control peak luminance (maximum luminance level) on the basis of an average picture level (APL), an actual gain measurement should be made for each point of a first point P1 to nth point Pn. For example, an actual gain measurement is performed at certain measurement points P1-Pn from maximum luminance gamma to minimum luminance gamma for RGB data signals. The gains other than those at the measurement points P1-Pn are linearly approximated. Thus, the use of the related art scheme (a) of comparative example requires more measurement time because every gain value should be on the basis of actual measurement values.

Meanwhile, in the scheme (b) of the first example embodiment, an actual gain measurement may only need to be performed with respect to two points P1 and Pn, the point P1 corresponds to maximum luminance gamma and the point Pn corresponds to minimum luminance gamma in order to control peak luminance (peak luminance) on the basis of the APL. For example, only the actual gain measurement value of the RGB data signals with respect to the maximum APL and that of the RGB data signals corresponding to a target peak luminance APL may need to be obtained. Gains other than the measurement points P1 and P2 may be calculated by the correction gain value Gain in accordance with the above Equation 2. Thus, the use of the scheme (b) of the first example embodiment may reduce measurement time because only the actual measurement values with respect to the two points may need to be measured.

Thus, the gain of the R data signal, the gain of the G data signal, and the gain of the B data signal can be obtained, respectively, by using the foregoing formula. Based on these gains, the PLC 113 can easily perform peak luminance control.

Meanwhile, in the data compensation unit 117, the correction gain values Gain of the RGB data signals may be configured as an IC, such as a field-programmable gate array (FPGA) and application-specific integrated circuit (ASIC). Thus, according to the scheme (b) of the first example embodiment, the correction gain values can be calculated in real time, and the PLC 113 can easily perform peak luminance control. And, since the correction gain values Gain may be digitized by external optical compensation equipment, a method of recording the correction gain values Gain in a storage device, e.g., a memory (e.g., EEPROM) storing the optical compensation LUT 119, which may interwork with the IC as the FPGA or ASIC or the image processing unit 110, may be used.

As discussed above, the scheme (b) of the first example embodiment may provide the gain value of the W data signal according to each APL value. And, the scheme (b) of the first example embodiment may increase or decrease the gain of the RGB data signals with respect to the maximum APL obtained through measurement and the gain of the RGB data signals with respect to the target peak luminance APL by a ratio of an APL to be used.

According to the foregoing description and example, the data compensation unit 117 may calculate the current gain, e.g., the correction gain value, of the G data signal (or R data signal) on the basis of the APL of target peak luminance in accordance with Equation 3 shown below.

Current gain of G data signal=(Max APL G gain−Target Peak Lum APL G gain)*{(Current APL−Target Peak Lum APL)/(Max APL−Target Peak Lum APL)}+Target Peak Lum APL G gain [Equation 3]

For example, "Max APL G gain" is an actual gain measurement value of the G data signal with respect to the maximum APL, "Target Peak Lum APL G gain" is an actual gain measurement value of the G data signal with respect to the target peak luminance APL, "Current APL" is a current APL, "Max APL" is a maximum APL, and "Target Peak Lum APL" is an APL of target peak luminance.

As can be seen from Equation 3, the correction gain value Gain of the G data signal according to the APL of the target peak luminance can be calculated by subtracting the target maximum APL from the current APL and the maximum from the current APL and the maximum APL. Therefore, in FIG. 9, the Target Peak Lum APL may be a setter (e.g., operator, programmer, or user) input variable limiting the APL of peak luminance by percent over the maximum APL (Max APL).

Also, according to the foregoing description, the data compensation unit 117 may calculate the current gain, i.e., the correction gain value, of the B data signal on the basis of the APL of target peak luminance in accordance with Equation 4 shown below.

Current gain of B data signal=(Max APL B gain−Target Peak Lum APL B gain)*{(Current APL−Target Peak Lum APL)/(Max APL−Target Peak Lum APL)}+Target Peak Lum APL B gain+B gain weight [Equation 4]

For example, "Max APL B gain" is an actual gain measurement value of the B data signal with respect to the maximum APL, "Target Peak Lum APL B gain" is an actual gain measurement value of the B data signal with respect to the target peak luminance APL, "Current APL" is a current APL, "Max APL" is a maximum APL, "Target Peak Lum APL" is an APL of target peak luminance, "Target Peak Lum APL" is an APL of target peak luminance, and "B gain weight" is a gain weight of the B data signal.

As can be seen from Equation 4, when the target peak luminance APL is subtracted from the current APL and the maximum APL, the correction gain value Gain of the B data signal according to the target peak luminance APL can be obtained. Thus, in FIG. 9, Target Peak Lum APL is a setter input variable limiting the target peak luminance APL by a percentage over the maximum APL.

Meanwhile, as well as the gain weight with respect to the B data signal, a gain weight with respect to the RG data signals may also be further added. As the gain weight, a value may be extracted through a linear equation using a difference between gain values of each actually measured APL of subpixels and gain values obtained through calculation. Generally, the value may be determined by luminance efficiency of an element used for subpixels and may be extracted through direct measurement of the element. As for a method of extracting the gain weight, the gain weight can be obtained by changing a difference between actually measured gain values of 10 points (e.g., 10, 20, 30, . . . , 80, 90, 100) of each APL and a calculation gain value into a linear equation. For example, the gain weights with respect to each RGB may become close to 0 as the APL and the gain value become proportional.

Examples of the related art scheme (a) of the comparative example and the scheme (b) of the first example embodiment as described above will be taken as follows.

Figure 10:
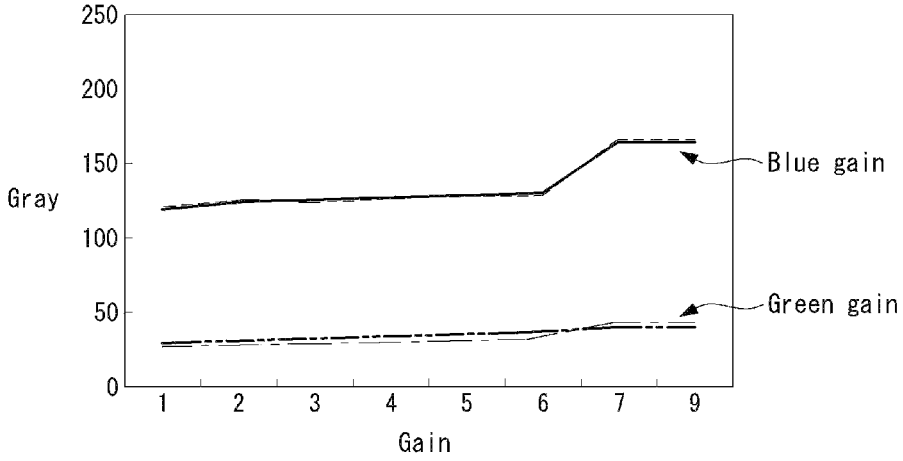
FIG. 10 is a graph of gain values over gray levels in which the comparative example scheme and the scheme of the first example embodiment are shown.

FIG. 10 is a gray level/gain value graph on the basis of the related art scheme (a) of comparative example and the scheme (b) of the first example embodiment. In FIG. 10, gray level/gain values with respect to the correction gain value (Green gain) of the G data signal and the correction gain value (Blue gain) of the B data signal are shown. Thus, the scheme (b) of the first embodiment is obtained the correction gain value similarly with the scheme (a)

Table 1 and Table 2 below show correction gain values (Table 1) using the related art scheme (a) of comparative example and correction gain values (Table 2) using the scheme (b) of the first example embodiment, respectively.

TABLE 1

Gain values set after actual direct measurement (APL 43.75%)

| | R gain | G gain | B gain |
|---|---|---|---|
| 255 | 0 | 29 | 120 |
| 223 | 0 | 31 | 125 |
| 191 | 0 | 32 | 125 |
| 159 | 0 | 32 | 127 |
| 127 | 0 | 34 | 130 |
| 95 | 0 | 36 | 129 |
| 63 | 0 | 40 | 165 |
| 31 | 0 | 40 | 165 |
| 0 | 0 | 0 | 0 |

TABLE 2

Calculated by using formula (APL 43.75%)

| | R gain | G gain | B gain |
|---|---|---|---|
| 255 | 0 | 28 | 120 |
| 223 | 0 | 29 | 124 |
| 191 | 0 | 29 | 127 |
| 159 | 0 | 31 | 128 |
| 127 | 0 | 33 | 130 |
| 95 | 0 | 33 | 130 |
| 63 | 0 | 43 | 164 |
| 31 | 0 | 43 | 164 |
| 0 | 0 | 0 | 0 |

In the formula of Table 2, the correction gain values (G gain, B gain) 29 and 27 of the G and B data signals may be calculated as follows.

Current gain of G data signal=(51−22)*{(43.75−25)/(100−25)}+22+0=29.25

Current gain of B data signal=(153−99)*{(43.75−25)/(100−25)}+99+15.14825=127.64825

For example, 15.14825, a gain weight of the B data signal, may be obtained such that, on the basis of the actual measurement value of the B subpixel formed in the display panel, the gain weight of the B data signal=−0.245 (43.75)+25.867=15.14825.

As can be seen from Table 1, Table 2, and FIG. 10, the gain of the actual measurement value according to the related art scheme (a) of comparative example and the gain using equation according to the first example embodiment may have similar gray levels. Thus, it can be noted that the method using the scheme (b) of the first example embodiment can exhibit gray levels similar or equal to those on the basis of the actual measurement, using an equation without performing actual measurement on every point.

Therefore, the scheme (b) of the first example embodiment can quickly and accurately implement desired target color coordinates and luminance for each display panel through the scheme of calculating the correction gain values of red, green, and blue which are supplied together (or emitted together in the display panel) to compensate for the white color coordinates by using an equation.

Hereinafter, a method for driving an organic light emitting display device according to the first example embodiment will be described.

Figure 11:
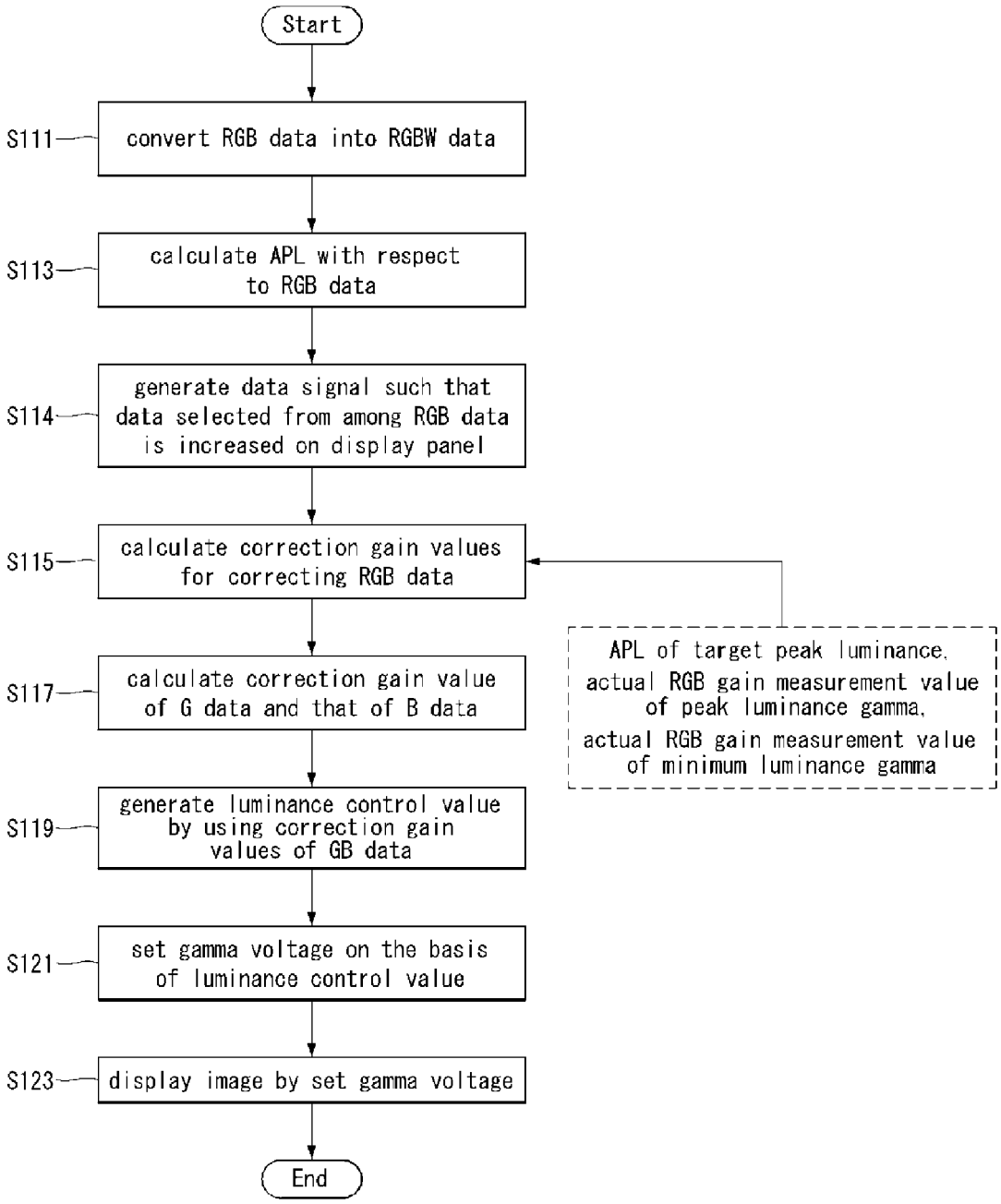
FIG. 11 is a flow chart illustrating a method of driving an organic light emitting display device according to the first example embodiment.

FIG. 11 is a flow chart illustrating a method of driving an organic light emitting display device according to the first example embodiment. The method will be further described with reference to FIGS. 1 to 11.

A method for driving an organic light emitting display device according to the first example embodiment may include a data conversion operation (S111), an APL calculation operation (S113), a data signal generation step (S114), a correction gain value calculation operation (S115), a luminance control value generation operation (S119), a gamma voltage setting operation (S121), and an image display operation (S123).

In response to RGB data signals RGB being supplied through the image processing unit 110, the first data conversion unit 116 may perform the data conversion operation (S111) of converting the RGB data signals RGB into RGBW data signals RGBW. The APL calculation unit 112 may perform the APL calculation operation (S113) of calculating an APL with respect to the RGB data signals RGB. In response to the color coordinates of the data signal W among the RGBW data signals being different from a target value, the data compensation unit 117 may perform the data signal generation operation (S114) of generating a data signal such that a data signal selected from the RGB data signals RGB may be supplied in the display panel 150.

In addition, the data compensation unit 117 may multiply a value, obtained by performing an arithmetic operation on a current APL and a maximum APL, to a value of the difference between a gain of the RGB data signals corresponding to the maximum APL and a gain of the RGB data signals corresponding to the target peak luminance APL to obtain a result value. Further, the data compensation unit 117 may perform the gain calculation operation (S115) of calculated correction gain values Gain of the RGB signals by adding the gain of the RGB data signals with respect to the target peak luminance APL to the result value.

In the gain calculation operation (S115), the correction gain values Gain may be calculated on the basis of the gain calculated through an equation expressed as follows: Current gain of a data signal selected from the RGB data signals RGB=(Max APL RGB gain−Target Peak Lum APL RGB gain)*{(Current APL−Target Peak Lum APL)/(Max APL−Target Peak Lum APL)}+Target Peak Lum APL RGB gain+RGB gain weight.

In this case, the data compensation unit 117 may calculate the correction gain value Gain of the G data signal through an equation expressed as follows: Current gain of the G data signal=(Max APL G gain−Target Peak Lum APL G gain)*{(Current APL−Target Peak Lum APL)/(Max APL−Target Peak Lum APL)}+Target Peak Lum APL G gain.

In addition, the data compensation unit 117 may calculate the correction gain value Gain of the B data signal through an equation expressed as follows: Current gain of the B data signal=(Max APL B gain−Target Peak Lum APL B gain)*{(Current APL−Target Peak Lum APL)/(Max APL−Target Peak Lum APL)}+Target Peak Lum APL B gain+B gain weight (operation S117).

For example, Target Peak Lum APL may be a setter (i.e., user) input variable limiting the APL of the target peak luminance. The gain weight of the B data signal may be prepared on the basis of an actual measurement value obtained by measuring the characteristics of the B subpixel SPb provided in the display panel 150.

The data compensation unit 117 may supply the correction gain value Gain of the data signal selected from among the RGB data signals RGB to the PLC 113. The PLC 113 may perform a luminance control value generation operation (S119) of generating a luminance control value plcc to control luminance of one or selected frame on the basis of the correction gain value Gain supplied from the data compensation unit 117.

The PLC 113 may supply the luminance control value plcc to the gamma unit 135. The gamma unit 135 may perform the gamma voltage setting operation (S121) of setting a gamma voltage on the basis of the luminance control value plcc supplied from the PLC 113. The data driver 130 may map the RGBW data signals RGBW supplied from the timing controller 120 on the basis of the gamma voltage, and may supply the same to the display panel 150.

The display panel 150 may perform the image display operation (S123) of displaying an image on the basis of the mapped RGBW data signals RGBW by the gamma voltage set by the gamma unit 135. Through the foregoing process, the display panel 150 may display an image having corrected color coordinates and controlled peak luminance.

Figure 12:
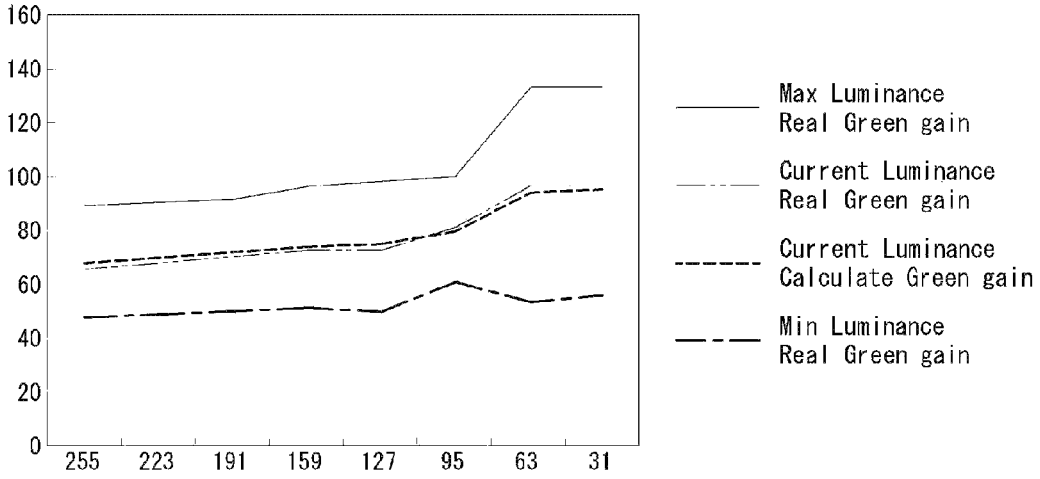
FIG. 12 is a graph of gain values according to the scheme of the first example embodiment, compared to actual gain values.
Figure 13:
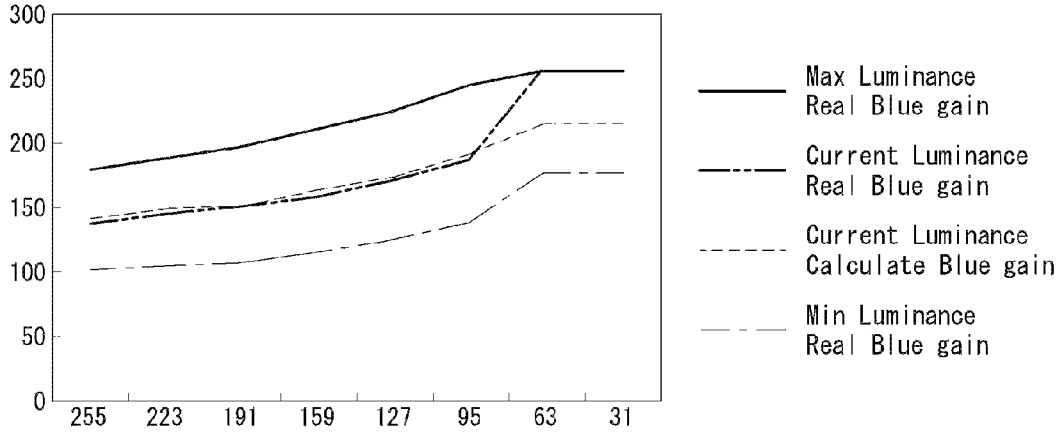
FIG. 13 is a graph of gain values according to the scheme of the first example embodiment, compared to actual gain values.

FIGS. 12 and 13 are graphs of gain values according to the scheme of the first example embodiment over actual gain values. In FIGS. 12 and 13, the X-axis indicates a gray level and the Y-axis indicates luminance.

As shown in FIGS. 12 and 13, the correction gain values (e.g., Current Luminance Calculate Green gain, Current Luminance Calculate Blue gain) of the GB data signals calculated according to the scheme (b) of the first example embodiment may be similar or equal to the correction gain values (e.g., Current Luminance Real Green gain, Current Luminance Real Blue gain) of the GB data signals actually measured according to the related art scheme (a) of the comparative example.

Meanwhile, the generation of differences, such as 63 gray levels and 31 gray levels in the correction gain value of the B data signal (as an example), may result from a limitation of the element. Thus, in the scheme (b) of the first example embodiment, the similar or equal correction gain values can be obtained without any other great error than that caused due to the limitation of the element.

Figure 14:
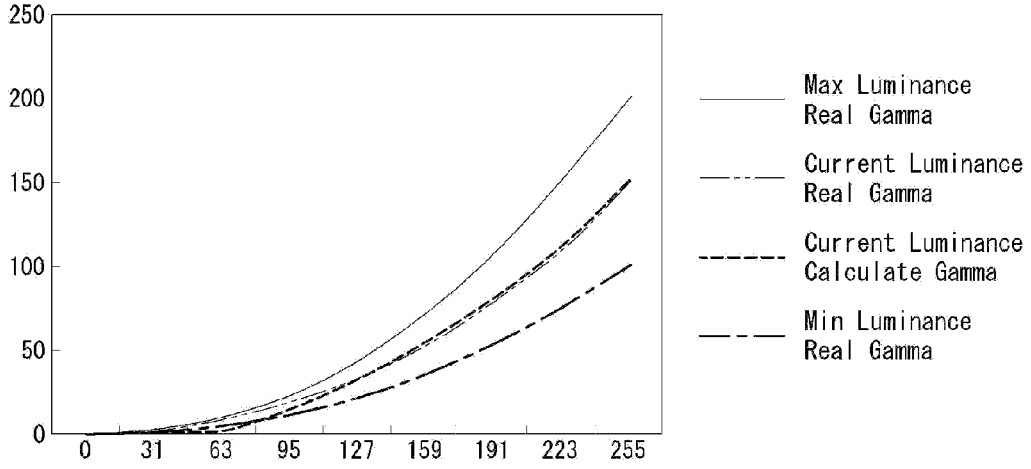
FIG. 14 is a graph of gamma curves according to the first example embodiment over gamma curves according to an actual measurement.
Figure 15:
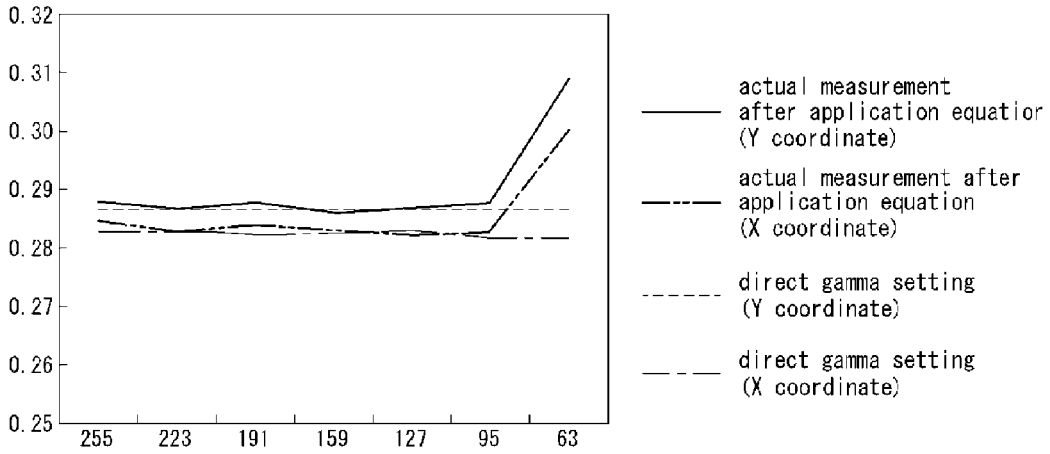
FIG. 15 is a graph showing color coordinates actually measured after the first example embodiment is applied over color coordinates according to direct gamma setting.

FIG. 14 is a graph of gamma curves according to the first example embodiment over gamma curves according to actual measurement. FIG. 15 is a graph showing color coordinates actually measured after the first example embodiment is applied over color coordinates according to direct gamma setting. In FIG. 14, the X-axis indicates a gray level, and the Y-axis indicates luminance. In FIG. 15, the X-axis indicates a gray level, and the Y-axis indicates color coordinates.

As shown in FIGS. 14 and 15, the luminance (Current Luminance Calculate Gamma) and color coordinates (actually measured X, Y coordinates after applying the formula) obtained by applying the correction gain values of the RGB data signals calculated according to the scheme (b) of the first example embodiment may be similar or equal to the luminance (Current Luminance Real Gamma) and the color coordinates (direct Gamma Setting X, Y coordinates) obtained by applying the actually measured correction gain values of the RGB data signals.

Thus, in the scheme (b) of the first example embodiment, the desired correction gain values of the RGB data signals can be obtained through the foregoing formulas without having to directly set (or actually measure) the correction gain values of the RGB data signals, and applied. Also, the scheme (b) of the first example embodiment can obtain accurate luminance and color coordinates in comparison to the related art peak luminance control method.

As discussed above, when a data signal is generated such that a selected data signal is supplied in the display panel and the correction gain values of the RGB data signals are calculated by the equations, the correction gain values of the RGB data signals that can implement accurate luminance and color coordinates can be obtained by simply measuring two points.

As described above, according to the first example embodiment, in obtaining the correction gain values of the red, green, and blue which may be supplied together to compensate white color coordinates, accurate values can be searched rapidly by each display panel by using the equations without having to directly obtaining a large amount of gain values. Also, according to the first example embodiment, in driving the PLC in the organic light emitting display device (RGBW OLED) having a sub-pixel structure including red, green, blue, and white, desired target color coordinates and luminance can be accurately implemented by display panel by finding correction gain values of red, green, and blue that are supplied together to compensate for white color coordinates.

Second Example Embodiment

Figure 16:
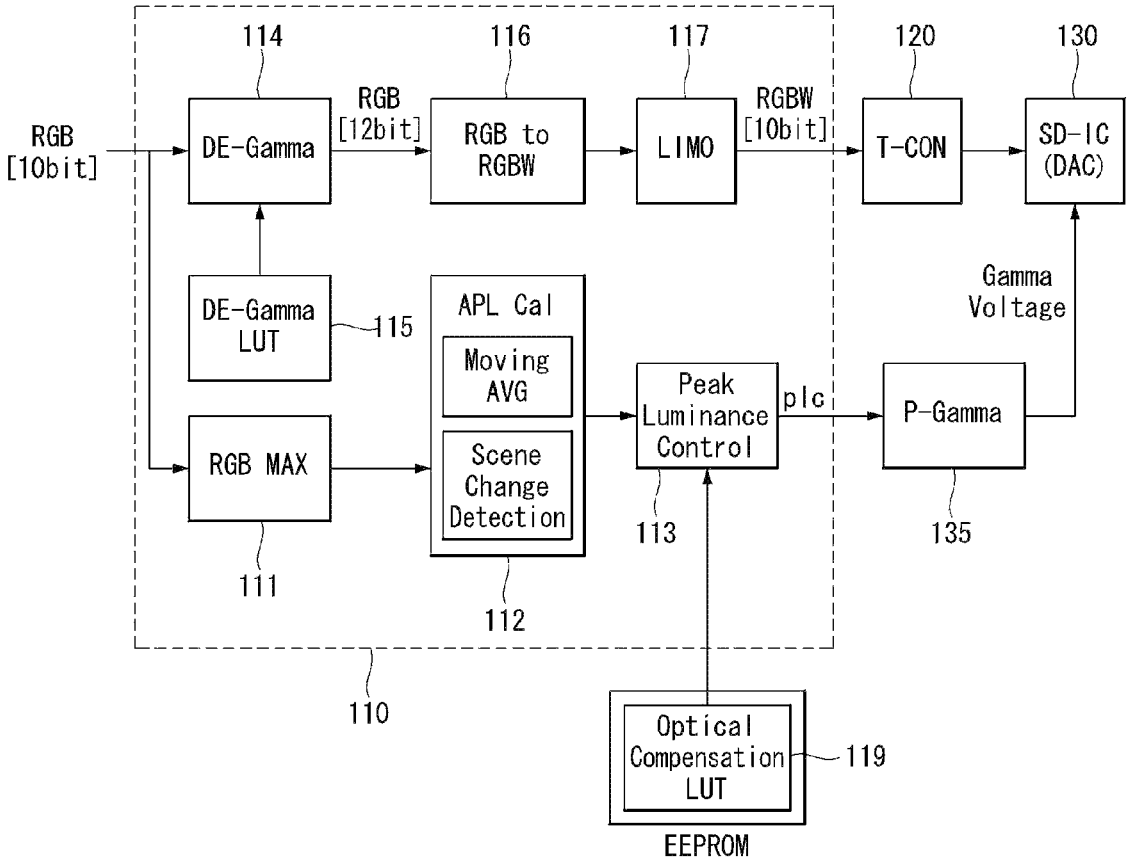
FIG. 16 is a block diagram showing an internal configuration of an image processing unit and peripheral circuit units according to a second example embodiment.
Figure 17:
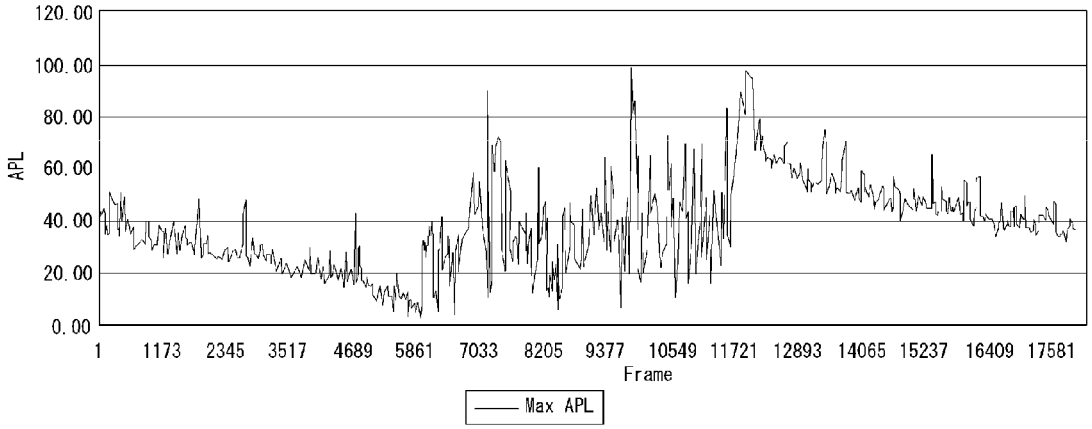
FIG. 17 is a graph showing a comparison between APLs of frames according to the related art method and a method of the second example embodiment.
Figure 17:
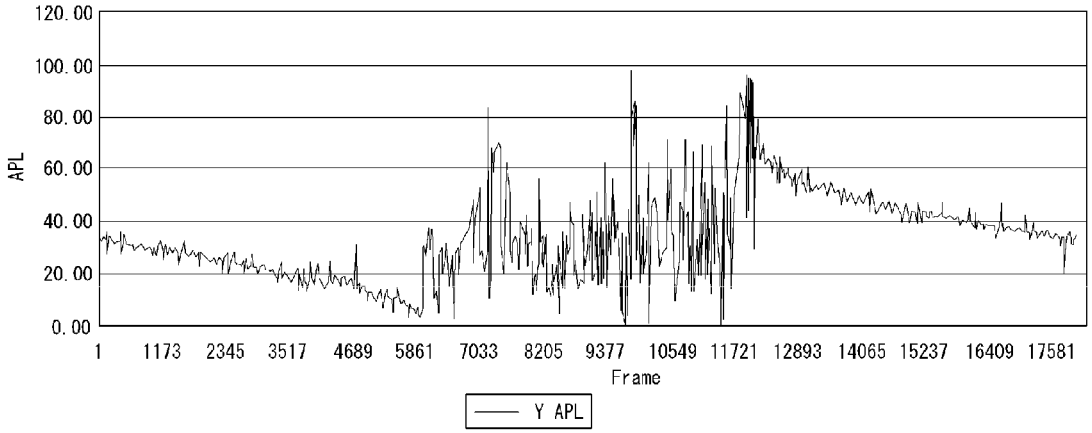

FIG. 16 is a block diagram showing an internal configuration of the image processing unit and peripheral circuit units according to a second example embodiment. FIG. 17 is a graph showing a comparison between APLs of the frames according to the related art scheme (Max APL) and a method of the second example embodiment (Y APL).

As shown in FIG. 16, the image processing unit 110 included in the organic light emitting display device according to the second example embodiment may include a data extraction unit 111, the APL calculation unit 112, the PLC 113, the DE-gamma unit 114, the first data conversion unit 116, and the data compensation unit (LIMO) 117.

The data extraction unit (RGB MAX) 111 may determine a representative value of every pixel in single frame data supplied from the outside, and may average the representative values of all of the pixels. As such, the data extraction unit 111 may select a representative value of every pixel such that a subpixel (e.g., a Max value of RGB data) having the largest amount of data among RGB subpixels in a single pixel (e.g., the sum of RGB subpixels) may be determined as a representative value, and then, may average the representative values of all of the pixels.

The APL calculation unit (APL Cal) 112 may calculate an APL by arithmetically operating the averaged representative values extracted from the data extraction unit 111. The APL calculation unit 112 may arithmetically operate again, for example, average again, the averaged representative values in units of Nth frames (e.g., 5 frames, 30 frames, or the like) such that the identical APL can be applied to a plurality of frames (a certain amount of frames). Problems, such as flickering, or the like, that may arise when every frame is calculated for expression can be prevented. The APL calculation unit 112 may calculate the APL on the basis of a moving AVG of an image or on the basis of scene change detection.

The PLC 113 may control luminance by each of at least one frame by using the APL and the LUT (optical compensation LUT) 119 calculated by the APL calculation unit 112. The PLC 113 may control luminance in units of a plurality of frames (by each frame group) using the APL. As such, the PLC 113 may control the luminance by controlling gamma such that a control signal plc to the gamma unit (P-Gamma) 135 that provides a gamma voltage to the data driver (SD-IC) 130.

For example, for the LUT 119, an internal or an external memory, such as EEPROM, storing an optical compensation data signal may be used. The gamma unit 135 may use programmable gamma capable of changing a gamma voltage (or a gamma curve) in response to the control signal plc supplied from the PLC 113. The foregoing data extraction unit 111, the APL calculation unit 112, and the PLC 113 may determine representative values of all of the pixels in the image processing unit 110, may average the representative values of all of the pixels to calculate an APL, and then, may control the luminance, which may reduce power consumption.

The method of controlling luminance using the data extraction unit 111, the APL calculation unit 112, and the PLC 113 is described as follows.

First, representative values of all of the pixels may be determined such that a subpixel having the largest amount of data among the RGB subpixels included in a single pixel may be determined as a representative value of the single pixel, and the representative values of all of the pixels may be averaged. As mentioned above, this operation may be performed by the data extraction unit 111.

Next, the extracted averaged representative values may be arithmetically operated to obtain an APL. As mentioned above, this operation may be performed by the APL calculation unit 112.

And then, the luminance may be controlled by each of at least one frame by using the calculated APL and the LUT. As mentioned above, this operation may be performed by the PLC 113. A reduction in power consumption of the display panel according to the luminance control method according to the second example embodiment will be described hereafter.

The DE-gamma unit 114 may de-gamma process the RGB data signals included in a single frame. For example, to prevent a bit overflow, or the like, that may occur during an arithmetic operation of converting the RGB data signals input from the outside into the RGBW data signals, the DE-gamma unit 114 may de-gamma process a received inverse gamma to change it into a linear form, and then may perform bit stretching thereon. As an example, through the bit stretching performed by the DE-gamma unit 114, the RGB data may be changed from 10 bits to 12 bits and then output.

The first data conversion unit (RGB to RGBW) 116 may convert the RGB data output from the DE-gamma unit 114 into RGBW data. One reason for converting the RGB data into the RGBW data using the first data conversion unit (RGB to RGBW) 116 is to drive the display panel including the RGBW subpixels.

In response to color coordinates of the W of the data in the form of RGBW output from the first data conversion unit 116 being different from a target value, the data compensation unit (LIMO) 117 may supply the other remaining RGB by a required amount together to perform compensation to express desired color coordinates. In an example using a display panel including RGBW subpixels, when a W image is expressed, only the W subpixel may be used. In such a case, in response to the color coordinates of the W subpixel being different from a target value, the data compensation unit 117 may supply the other remaining RGB by a required amount to adjust the color coordinates different from the target value to desired color coordinates. Therefore, the data compensation unit 117 generates the compensated RGBW data signals by adding at least one of R, G and B signal to W signal, as shown in FIG. 7. For example, the data in the form of RGBW may be changed from 12 bits to 10 bits through a data conversion process by the data compensation unit 117 to be output.

Since the data extraction unit 111, the APL calculation unit 112, and the PLC 113 may be used, the foregoing image processing unit 110 can further reduce power consumption than the related art method, and this will be described as follows.

In the related art scheme, an APL is calculated by using Equation 5 shown below to control the luminance.

$$APL=(\text{Current } Y/\text{Full white } Y)\times 100 \quad \text{[Equation 5]}$$

In Equation 5, "APL" indicates an average picture level, "Current" indicates a current, "Full white" indicates full white, and "Y" indicates luminance.

According to Equation 5, luminance is determined by $Y=(0.3)*R+(0.6)*G+(0.1)*B$.

In an example using RGB=(0, 0, 255), luminance Y is $Y=(0.3)*0+(0.6)*0+(0.1)*255=25.5$ and $APL=(25.5/255)*100=10\%$.

In such a case, when peak luminance control is 150/500, the full image of B is 500 nits (in an example in which a target APL is 30%).

In consideration of the fact that the peak luminance control aims at high contrast ratio and low power consumption, the full image of B used in the illustration does not belong. In other words, it may not be absolutely necessary to emit up to the peak luminance, but the related art method performs driving at high luminance, anyway. As a result, the related art method results in increasing power consumption of the display panel meaninglessly.

Meanwhile, in the method of the second example embodiment, an APL may be calculated by using Equation 6 shown below to control luminance.

$$APL=Avg.\{Max(R,G,B)/255\}\times 100 \quad \text{[Equation 6]}$$

In Equation 6, "APL" indicates an average picture level, "Avg" indicates average, and "Max" indicates a maximum value of RGB data in 255 gray levels.

As can be seen from Equation 5 and Equation 6, in the related art method, the APL is calculated by using a current according to luminance, while in the method of the second example embodiment, the APL may be calculated by using a maximum value (Max) of the RGB data having the largest amount of data.

For example, it may be presumed that RGB=(0, 0, 255) and luminance $Y=(255/255)\times 100=100\%$.

In this example, when peak luminance control is 150/500, a full image of B may be 150 nits. Thus, in comparison to the current (based on 500 nits) used in the related art method, the full image of B according to the method of the second example embodiment can achieve efficiency of reducing power consumption by more than 70%.

In another example, it may be presumed that RGB=(255, 5, 2) and luminance $Y=(255/255)\times 100=100\%$.

Also, in this example, when peak luminance control is 150/500, a full image of R is 150 nits. Thus, in comparison to the current (500 nits) used in the related art method, the full image of R, according to the method of the second example embodiment, can achieve efficiency of reducing power consumption by more than 70%.

Meanwhile, when peak luminance control is performed under the same condition, the related art method and the method of the second example embodiment have a difference in power consumption as shown in Table 3 and Table 4 below.

TABLE 3

| Related art method | | | | | | | |
|---|---|---|---|---|---|---|---|
| Panel (A) | White | Red | Green | Blue | Cyan | Magenta | Yellow |
| Full image | 7.79 | 34.63 | 13.88 | 27.58 | 22.16 | 57.66 | 21.21 |

TABLE 4

| Method of second example embodiment | | | | | | | |
|---|---|---|---|---|---|---|---|
| Panel (A) | White | Red | Green | Blue | Cyan | Magenta | Yellow |
| Full image | 7.79 | 10.39 | 9.02 | 8.27 | 17.29 | 18.66 | 19.41 |

As can be seen from Table 3 and Table 4, the related art method consumes a great amount of consumption in the pure color series, exhibiting high power consumption. Meanwhile, in the method of the second example embodiment, since power consumption of the pure color series may be significantly reduced, it may be lower in comparison to that of the related art method.

Also, as can be seen from FIG. 17, the method of the second example embodiment may reduce power consumption only in the pure color series without making a great difference from the related art method, and does not affect the distribution of the overall APL.

As described above, the second example embodiment can provide an organic light emitting display device capable of calculating an APL by an RGB maximum value and controlling peak luminance on the basis of the APL, reducing power consumption. Also, in the second example embodiment, as power consumption in the pure color series may be drastically reduced, power consumption can be reduced in peak luminance control driving in the organic light emitting display device (RGBW OLED), including RGBW.

Meanwhile, in the above description, the first and second example embodiments are described separately, but the elements included in the first and second example embodiments may be combined to be configured as necessary. Thus, the second data conversion unit included in the first example embodiment may be replaced by the data extraction unit included in the second example embodiment, or the data compensation unit included in the second example embodiment may be replaced by the data compensation unit included in the first example embodiment. Embodiments of the present invention are not limited to these examples.

It should also be appreciated that the above examples using R, G, and B individually and in various combinations, e.g., RG, GB, etc., are not limited to the combinations described, and may be used singly or in combination as may be appreciated to one of ordinary skill in the art.

It will be apparent to those skilled in the art that various modifications and variations can be made in the organic light emitting diode display device and method of driving the same of embodiments of the present invention without departing from the spirit or scope of the invention. Thus, it is intended that the present invention cover the modifications and variations of this invention provided they come within the scope of the appended claims and their equivalents.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. As an example, although an EEPROM is described as a memory, embodiments include other types of nonvolatile and volatile memories. Accordingly, other implementations are within the scope of the following claims.

What is claimed is:

1. An organic light emitting display device, comprising:

a display panel comprising red, green, blue, and white (RGBW) subpixels;

a first data conversion unit configured to convert red, green, and blue (RGB) data signals into RGBW data signals;

an average picture level calculation unit configured to calculate an average picture level (APL) for the RGB data signals;

a peak luminance controller configured to control luminance of at least one frame by using the APL and a look-up table; and a data compensation unit configured to:

perform a compensation operation on at least one of the RGB data signals in response to color coordinates of white (W) data signals among the RGBW data signals output from the first data conversion unit being different from a target value;

multiply an arithmetical value, obtained by performing an arithmetical operation on a current APL and a maximum APL, with a difference value corresponding to a difference between a gain of the RGB data signals corresponding to the maximum APL and a gain of the RGB signals corresponding to a target peak luminance APL;

add the gain of the RGB data signals corresponding to the target peak luminance APL to a result value of the multiplication to calculate correction gain values for the RGB data signals; and calculate the correction gain value of at least one of the RGB data signals, based on a gain calculated in accordance with the following equation:

Current gain of data signal selected from among the RGB data signals=(Max APL RGB gain−Target Peak Lum APL RGB gain)*{(Current APL−Target Peak Lum APL)/(Max APL−Target Peak Lum APL)}+Target Peak Lum APL RGB gain+RGB gain weight, where:

Max APL RGB gain is an actual gain measurement value of the selected RGB data signal corresponding to the maximum APL, Target Peak Lum APL RGB gain is an actual gain measurement value of the selected RGB data signal corresponding to the target peak luminance APL, Current APL is a current APL, Max APL is a maximum APL, Target Peak Lum APL is a target peak luminance APL, and RGB gain weight is a gain weight of the selected RGB data signal.

2. The organic light emitting display device of claim 1, wherein the data compensation unit is further configured to calculate the correction gain values, based on a gain calculated in accordance with the following equation:

Current gain of data signal selected from among the RGB data signals=(Max APL RGB gain−Target Peak Lum APL RGB gain)*{(Current APL−Target Peak Lum APL)/(Max APL−Target Peak Lum APL)}+Target Peak Lum APL RGB gain+RGB gain weight, wherein:

Max APL RGB gain is an actual gain measurement value of the RGB data signals corresponding to the maximum APL, Target Peak Lum APL RGB gain is an actual gain measurement value of the RGB data signals corresponding to the target peak luminance APL, Current APL is a current APL, Max APL is a maximum APL, Target Peak Lum APL is a target peak luminance APL, and RGB gain weight is a gain weight of the RGB data signals.

3. The organic light emitting display device of claim 2, wherein:

the data compensation unit is further configured to apply the gain calculated in accordance with the equation to the green and blue (GB) data signals; and the gain weights of the RGB data signals are prepared based on actual measurement values obtained by measuring characteristics of the RGB subpixels on the display panel.

4. The organic light emitting display device of claim 1, wherein the data compensation unit calculates the correction gain value of the green (G) data signal through the following equation:

Current gain of G data signal=(Max APL G gain−Target Peak Lum APL G gain)*{(Current APL−Target Peak Lum APL)/(Max APL−Target Peak Lum APL)}+Target Peak Lum APL G gain, wherein:

Max APL G gain is an actual gain measurement value of the G data signal corresponding to the maximum APL, Target Peak Lum APL G gain is an actual gain measurement value of the G data signal corresponding to the target peak luminance APL, Current APL is a current APL, Max APL is a maximum APL, and Target Peak Lum APL is an APL of target peak luminance.

5. The organic light emitting display device of claim 4, wherein the Target Peak Lum APL is a setter input variable limiting the APL of the target peak luminance.

6. The organic light emitting display device of claim 1, wherein the data compensation unit calculates the correction gain value of the blue (B) data signal through the following equation:

Current gain of B data signal=(Max APL B gain−Target Peak Lum APL B gain)*{(Current APL−Target Peak Lum APL)/(Max APL−Target Peak Lum APL)}+Target Peak Lum APL B gain+B gain weight, wherein:

Max APL B gain is an actual gain measurement value of the B data signal corresponding to the maximum APL, Target Peak Lum APL B gain is an actual gain measurement value of the B data signal corresponding to the target peak luminance APL, Current APL is a current APL, Max APL is a maximum APL, Target Peak Lum APL is an APL of target peak luminance, and B gain weight is a gain weight of the B data signal.

7. The organic light emitting display device of claim 6, wherein the Target Peak Lum APL is a setter input variable limiting the APL of the target peak luminance.

8. A method of driving an organic light emitting display device, the method comprising: converting red, green, and blue (RGB) data signals into red, green, blue, and white (RGBW) data signals;

calculating an average picture level (APL) for the RGB data signals;

generating data signals, such that a data signal selected from among the RGB signals is supplied in a display panel in response to color coordinates of the white (W) data signal among the RGBW data signals being different from a target value; and calculating gain by:

multiplying an arithmetical value, obtained by performing an arithmetical operation on a current APL and a maximum APL, with a value corresponding to a difference between a gain of the RGB data signals corresponding to the maximum APL and a gain of the RGB signals corresponding to a target peak luminance APL; and adding the gain of the RGB data signals corresponding to the target peak luminance APL to the result value of the multiplication to calculate respective correction gain values of the RGB data signals, wherein the correction gain values are calculated based on a gain calculated in accordance with the following equation:

Current gain of data signal selected from among the RGB data signals=(Max APL RGB gain−Target Peak Lum APL RGB gain)*{(Current APL−Target Peak Lum APL)/(Max APL−Target Peak Lum APL)}+Target Peak Lum APL RGB gain+RGB gain weight, where:

Max APL RGB gain is an actual gain measurement value of the selected RGB data signal corresponding to the maximum APL, Target Peak Lum APL RGB gain is an actual gain measurement value of the selected RGB data signal corresponding to the target peak luminance APL, Current APL is a current APL, Max APL is a maximum APL, Target Peak Lum APL is a target peak luminance APL, and RGB gain weight is a gain weight of the selected RGB data signal.

9. The method of claim 8, further comprising:

controlling luminance of at least one frame based on the correction gain values, wherein the luminance control value is used for setting a gamma voltage.

10. The method of claim 8, wherein the correction gain value of the green (G) data signal is calculated in accordance with the following equation:

Current gain of G data signal=(Max APL G gain−Target Peak Lum APL G gain)*{(Current APL−Target Peak Lum APL)/(Max APL−Target Peak Lum APL)}+Target Peak Lum APL G gain, wherein:

Max APL G gain is an actual gain measurement value of the G data signal corresponding to the maximum APL, Target Peak Lum APL G gain is an actual gain measurement value of the G data signal corresponding to the target peak luminance APL, Current APL is a current APL, Max APL is a maximum APL, and Target Peak Lum APL is an APL of target peak luminance.

11. The method of claim 10, wherein the Target Peak Lum APL is a setter input variable limiting the APL of the target peak luminance.

12. The method of claim 8, wherein the correction gain value of the blue (B) data signal is calculated in accordance with the following equation:

Current gain of B data signal=(Max APL B gain−Target Peak Lum APL B gain)*{(Curr ent APL−Target Peak Lum APL)/(Max APL−Target Peak Lum APL)}+Target Peak Lum APL B gain+B gain weight, wherein:

Max APL B gain is an actual gain measurement value of the B data signal corresponding to the maximum APL, Target Peak Lum APL B gain is an actual gain measurement value of the B data signal corresponding to the target peak luminance APL, Current APL is a current APL, Max APL is a maximum APL, Target Peak Lum APL is an APL of target peak luminance, and B gain weight is a gain weight of the B data signal.

13. The method of claim 12, wherein the Target Peak Lum APL is a setter input variable limiting the APL of the target peak luminance.

14. The method of claim 12, wherein the gain weights of the RGB data signals are prepared based on actual measurement values obtained by measuring characteristics of the RGB subpixels.

15. An organic light emitting display device, comprising:

a display panel comprising red, green, blue, and white (RGBW) subpixels;

a scan driver and a data driver configured to drive scan lines and data lines of the display panel, respectively;

a timing controller configured to control the scan driver and the data driver;

a data extraction unit configured to:

determine a representative value of every pixel in one frame data supplied externally from the device; and average the representative values over all of the pixels;

an average picture level (APL) calculation unit configured to calculate an APL by performing an arithmetical operation on the averaged representative values extracted from the data extraction unit; and a peak luminance controller (PLC) configured to control luminance of each of at least one frame by using the APL calculated by the APL calculation unit and a look-up table, wherein the controlling luminance includes calculating a correction gain value of at least one RGB data signal, based on a gain calculated in accordance with the following equation:

Current gain of data signal selected from among the RGB data signals=(Max APL RGB gain−Target Peak Lum APL RGB gain)*{(Current APL−Target Peak Lum APL)/(Max APL−Target Peak Lum APL)}+Target Peak Lum APL RGB gain+RGB gain weight, wherein:

Max APL RGB gain is an actual gain measurement value of the selected RGB data signal corresponding to the maximum APL, Target Peak Lum APL RGB gain is an actual gain measurement value of the selected RGB data signal corresponding to the target peak luminance APL, Current APL is a current APL, Max APL is a maximum APL, Target Peak Lum APL is a target peak luminance APL, and RGB gain weight is a gain weight of the selected RGB data signal.

16. The organic light emitting display device of claim 15, wherein the data extraction unit is further configured to:

determine a representative value for each respective pixel, such that a subpixel value comprising a greatest data value among RGB subpixels in a single pixel is determined as a representative value for the single pixel; and subsequently average the representative values over all of the pixels.

17. The organic light emitting display device of claim 15, wherein the data extraction unit, the APL calculation unit, and the PLC are included in an image processing unit configured to supply frame data to the timing controller.

18. A method of driving an organic light emitting display device, the method comprising:

determining a representative value for each respective pixel, such that a subpixel value comprising a greatest data value among red, green, and blue (RGB) subpixels in a single pixel is determined as a representative value for the single pixel;

subsequently averaging the representative values over all of the pixels;

calculating an average picture level (APL) by performing an arithmetical operation on the averaged representative values; and controlling luminance of each of at least one frame by using the calculated APL and a look-up table, wherein the controlling luminance includes calculating a correction gain value of at least one RGB data signal, based on a gain calculated in accordance with the following equation:

Current gain of data signal selected from among the RGB data signals=(Max APL RGB gain−Target Peak Lum APL RGB gain)*{(Current APL−Target Peak Lum APL)/(Max APL−Target Peak Lum APL)}+Target Peak Lum APL RGB gain+RGB gain weight, wherein:

Max APL RGB gain is an actual gain measurement value of the selected RGB data signal corresponding to the maximum APL, Target Peak Lum APL RGB gain is an actual gain measurement value of the selected RGB data signal corresponding to the target peak luminance APL, Current APL is a current APL, Max APL is a maximum APL, Target Peak Lum APL is a target peak luminance APL, and RGB gain weight is a gain weight of the selected RGB data signal.

19. The method of claim 18, wherein, in the controlling luminance, the luminance is controlled in units of a plurality of frames by using the APL.

20. The method of claim 19, wherein, in the calculating of an APL, the averaged representative values are performed in units of Nth frames such that the identical APL is applied to the plurality of frames.

* * * * *